US007105737B2

(12) United States Patent
Frangopol et al.

(10) Patent No.: US 7,105,737 B2
(45) Date of Patent: Sep. 12, 2006

(54) MIDI SCALABLE POLYPHONY BASED ON INSTRUMENT PRIORITY AND SOUND QUALITY

(75) Inventors: Radu C. Frangopol, Plantation, FL (US); Marc A. Boillot, Plantation, FL (US); Jean Khawand, Miami, FL (US)

(73) Assignee: Motorola, Inc., Schaumburg, IL (US)

( * ) Notice: Subject to any disclaimer, the term of this patent is extended or adjusted under 35 U.S.C. 154(b) by 202 days.

(21) Appl. No.: 10/849,628

(22) Filed: May 19, 2004

(65) Prior Publication Data

US 2005/0257669 A1 Nov. 24, 2005

(51) Int. Cl.
*G10H 7/00* (2006.01)

(52) U.S. Cl. ..... 84/615; 84/645

(58) Field of Classification Search ..... 84/645, 84/615; 704/278

See application file for complete search history.

(56) References Cited

U.S. PATENT DOCUMENTS 5,734,119 A * 3/1998 France et al. ..... 84/622
2001/0045155 A1* 11/2001 Boudet et al. ..... 84/645
2004/0159219 A1* 8/2004 Holm et al. ..... 84/645
2004/0209629 A1* 10/2004 Virolainen et al. ..... 455/466
2004/0267541 A1* 12/2004 Hamalainen et al. ..... 704/278

OTHER PUBLICATIONS

NOKIA, "Using the Nokia Sound Converter," Version 1.0, Jul. 23, 2003.

MIDI Maufacturers Association, "Supporting the Arts Through Technology," 1-4, www.midi.org/about-midi/abtspmidi.shtml, May 6, 2004.

Beatnik, Inc., "Enhanced Audio Solutions," 1-3, http://Jun. 6, 2004.

* cited by examiner

*Primary Examiner*—Lincoln Donovan
*Assistant Examiner*—Christina Russell

(57) ABSTRACT

A method of scaling polyphony can include identifying music data to be played (415), wherein the music data indicates instruments to be used and each instrument has an assigned priority. A measure of polyphony needed to play the music data can be compared with polyphony of a sound generating device (425). If the measure of polyphony exceeds the polyphony of the sound generating device, the music data can be played without using one or more instruments indicated by the music data according to the assigned priorities (440, 460).

16 Claims, 3 Drawing Sheets

400

200

| INSTRUMENT | PRIORITY |
|---|---|
| SLIDE GUITAR | 1 |
| SLAP BASS | 2 |
| VIOLIN | 3 |
| PIANO | 4 |
| CONGAS | 5 |
| COWBELL | 6 |
| SHAKER | 7 |
| XYLOPHONE | 8 |
| TIMPANI | 9 |

POLYPHONY AVAILABLE IN MIDI DEVICE =8

300

| INSRTUMENT | QUAILITY RATING | THRESHOLD | SUBSTITUTED |
|---|---|---|---|
| SLIDE GUITAR | 3 | 4 | CLEAN GUITAR |
| SLAP BASS | 4 | 2 | N/A |
| VIOLIN | 5 | 2 | N/A |

305

310

| N-NEAREST NEIGHBOR FOR SLIDE GUITAR | RATING |
|---|---|
| ELECTRIC GUITAR | 4 |
| CLEAN GUITAR | 5 |
| DOBRO GUITAR | 4 |

| N-NEAREST NEIGHBOR FOR SLAP BASS | RATING |
|---|---|
| ELECTRIC BASS | 4 |
| UPRIGHT BASS | 5 |

315

FIG. 3

MIDI SCALABLE POLYPHONY BASED ON INSTRUMENT PRIORITY AND SOUND QUALITY

BACKGROUND

1. Field of the Invention

The present invention relates to the field of sound generation devices and, more particularly, to regulating usage of polyphony within such devices.

2. Description of the Related Art

The Musical Instrument Digital Interface (MIDI) protocol can be used to control MIDI compatible sound generation devices such as synthesizers, computers, and the like. In general, MIDI data can specify which notes are to be played, the timing of those notes, and what type of instruments are to be used to play designated notes. In this manner, a MIDI device can interpret a MIDI file to render an audible version of a musical composition.

MIDI devices are limited with respect to the number of voices or notes that can be played simultaneously. This characteristic is referred to as "polyphony". For example, a device having 64-voice polyphony can play 64 different notes simultaneously, assuming each note can be generated using a single voice. MIDI devices can have varying abilities with respect to polyphony. In illustration, a computer-based system may be able to play more than one-hundred voices simultaneously while a mobile communication device, such as a mobile phone having limited computing resources, may only be able to play 8 voices simultaneously.

For a MIDI device to play a composition requiring more voices than are available on the device, particular notes must not be played by selectively silencing or ignoring the notes. Solutions for overcoming polyphony limitations, referred to as "note stealing", have varied from manufacturer to manufacturer. This has resulted in a randomization of which notes of a composition, as specified by the MIDI data, are played from one manufacturer's device to the next. In consequence, the same MIDI file can sound vastly different when played on different MIDI devices lacking sufficient polyphony to play the composition as intended by the composer.

One proposed solution has been the Scalable Polyphony (SP) MIDI protocol. The SP MIDI protocol attempts to make content scalable across devices with different polyphonic capabilities. SP MIDI defines new MIDI messages that can indicate how MIDI data should be performed by devices with different polyphony.

Generally, different priorities are assigned to MIDI channels. One or more initialization messages, such as an SP-MIDI Maximum Instantaneous Polyphony (MIP) Message and a Device Initialization Message, are sent or read. The MIP message informs the SP MIDI device about the polyphony requirements for each MIDI Channel as well as the channel priority order for a given composition. The Device Initialization message sets the SP MIDI device to a proper mode, such as General MIDI or Down Loadable Song (DLS) format. The SP MIDI device then applies channel masking to the MIDI data such that only those notes on selected MIDI channels, i.e. those having a high priority, are played.

While SP MIDI can address polyphony limitations of MIDI devices, the protocol does have disadvantages. One such disadvantage stems from the fact that SP MIDI relies upon MIDI channel selection to address polyphony scaling. MIDI channel selection as a means of polyphony scaling can negatively impact the quality of music that results. Since more than one type of instrument can be assigned to a single MIDI channel, an instrument part that is characteristic of a composition may be inadvertently silenced if that instrument is assigned to a channel that is to be masked. As such, channel selection may ignore aspects of musicality such as which instruments are used for playing a composition as well as the sonic quality of the instruments that are used. Presently, no existing solution for polyphony scaling accounts for instrument selection or the sonic quality of the instruments selected for playing a composition.

SUMMARY OF THE INVENTION

The present invention provides a method and apparatus for scaling polyphony within sound sources. Additionally, the embodiments disclosed herein can evaluate the sound quality of instruments used for a given composition as well as select alternatives for instruments of lesser sonic quality. The present invention can be implemented within a sound generation device, including but not limited to, a mobile communication device such as a mobile phone.

One embodiment of the present invention can include a method of scaling polyphony. The method can include identifying music data, wherein the music data indicates instruments to be used and each instrument has an assigned priority. A measure of polyphony needed to play the music data can be compared with polyphony of a sound generating device. If the measure of polyphony exceeds the polyphony of the sound generating device, the music data can be played without using one or more instruments indicated by the music data according to the assigned priorities.

Another embodiment of the present invention can include a method of selecting instruments. The method can include identifying music data and, for at least one instrument indicated by the music data, comparing a quality rating of the instrument with a threshold corresponding to the instrument. If the quality rating of the instrument is less than the threshold, a replacement instrument can be substituted for the instrument, so long as the replacement instrument has a quality rating that is higher than the threshold. The music data can be played using the replacement instrument(s).

Yet another embodiment of the present invention can include a machine readable storage programmed to cause a machine to perform the various steps disclosed herein.

BRIEF DESCRIPTION OF THE DRAWINGS

There are shown in the drawings, embodiments which are presently preferred, it being understood, however, that the invention is not limited to the precise arrangements and instrumentalities shown.

FIG. 3 is a schematic diagram illustrating instrument substitutions in accordance with another embodiment of the present invention.

DETAILED DESCRIPTION OF THE INVENTION

Figures 1, 2:
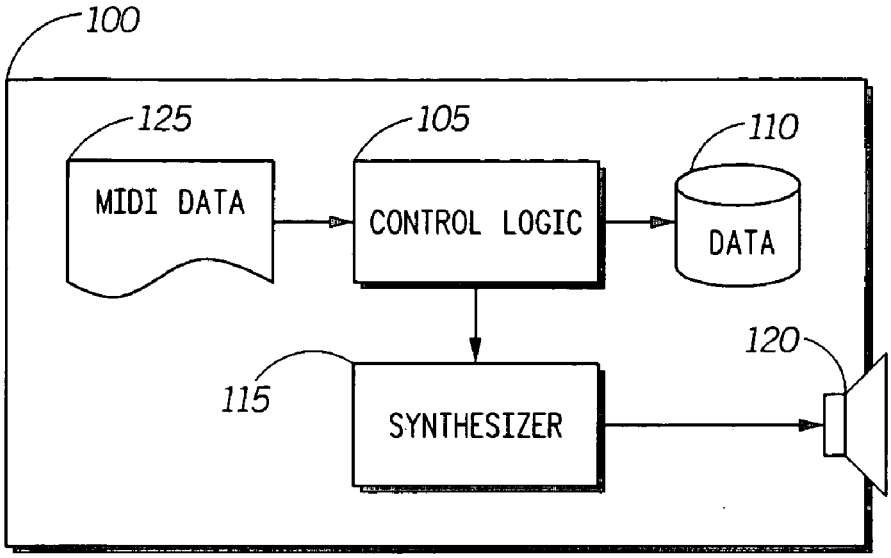
FIG. 1 is a schematic diagram illustrating a Musical Instrument Digital Interface (MIDI) processing system for use with a mobile device in accordance with one embodiment of the present invention.
FIG. 2 is a schematic diagram illustrating instrument priority assignments in accordance with another embodiment of the present invention.

FIG. 1 is a schematic diagram illustrating a Musical Instrument Digital Interface (MIDI) processing system for use with a mobile device 100 in accordance with one embodiment of the present invention. It should be appreciated, however, that while the inventive arrangements disclosed herein are illustrated in the context of a mobile communication device, such as a mobile phone, the present invention is not limited to such an implementation. Rather, the embodiments disclosed herein can be used within any sound generating device that is MIDI-enabled. As shown, the MIDI processing system can include control logic 105, a data store 110, a synthesizer 115, as well as an output transducer 120 such as a speaker.

MIDI data 125, specifying a musical composition or other collection of one or more notes and performance data, can be provided to, or read by, the control logic 105. According to one embodiment of the present invention, the MDI data 125 can specify a prioritization of instruments or samples used by the composition. That is, the MIDI data 125 can specify a listing of instruments in decreasing order of importance with respect to the composition to be played. This allows a composer to list which instruments are most important to the character and musicality of a given composition.

Accordingly, a MIDI-processing system having limited polyphony can play the parts assigned to the most important instruments as specified by the MIDI data 125 so that the composition retains its musical character in accordance with the composer's intent. Musical parts specified by the MIDI data 125 that are played by instruments of lesser priority can be ignored or masked. Thus, in a MIDI device having 8-voice polyphony, assuming each instrument plays a single note and requires a single voice of the synthesizer 115 to do so, instruments having a priority of 9 or above can be masked in favor of the instruments having priorities of 1–8.

The control logic 105 can parse the MIDI data 125 and determine which instruments are to play notes specified by the received MIDI data 125. The control logic 105, being communicatively linked to the data store 110 and synthesizer 115, can provide instructions to the synthesizer 115 to use instruments for playback of the MIDI data 125 in accordance with instrument priority and performance data extracted or interpreted from the MIDI data 125, and other data stored in the data store 110.

The data store 110 can be static or dynamic memory, or a portion thereof, that includes information specifying the conditions under which various instruments are to be used for a given composition. The data store 110 can be a dedicated data store, or can be integrated within the control logic 105 or the synthesizer 115. In accordance with one embodiment of the present invention, the data store 110 can specify quality ratings for instruments available in the MIDI processing system. The data store 110 further can specify thresholds which can be compared to the quality ratings. For one or more of the instruments available within the MIDI processing system, the data store 110 also can specify "N" alternative instruments. In another embodiment of the present invention, alternative instruments for the composition can be specified by the MIDI data 125.

The synthesizer 115 can include a sample playback engine, or digital oscillator, as well as a digitally controlled amplifier to regulate the volume of sample playback. The synthesizer 115 also can include one or more low frequency oscillators which can contribute to the vibrato and tremolo, and one or more envelope generators to define an overall volume and pitch shape to samples. While the synthesizer 115 can be implemented using various discrete components, in another embodiment, one or more aspects of sound generation and sample playback can be performed through digital signal processing (DSP) techniques executed by a suitable processor or controller.

In operation, the control logic 105 can interpret the MIDI data 125. The control logic 105 can determine which instruments are to be used for the musical composition specified by the MIDI data 125 as well as the required polyphony. The polyphony requirements of the composition can be compared with the available polyphony of the mobile device 100. The control logic 105 can filter out or mask instruments of a lesser priority based upon the available polyphony of the mobile device 100.

Of the instruments that are high enough priority to be played, the control logic 105 can determine whether substitution of a higher quality instrument is merited based upon the N alternative instruments listed in the data store 110, the quality rating of each instrument to be used in the composition, the quality ratings of the alternative instruments, and the thresholds set within the MIDI processing system for comparing the quality ratings.

The control logic 105 can instruct the synthesizer 115 to play the composition specified by the MIDI data 125 using only designated instruments after considering instrument priority in light of available polyphony and any instrument alternatives. That is, the particular parts or lines of the composition corresponding to selected instruments can be played using the instrument or sound associated with that part or line. Parts or lines of the composition associated with lower priority instruments can be masked. The synthesizer 115, operating under control of the control logic 105, can drive the transducer 120 to produce sound.

It should be appreciated that the MIDI processing system disclosed herein has been provided for purposes of illustration only. As such, the examples described herein are not to be construed as limitations of the present invention. For example, the various components of the MIDI processing system can be implemented as one or more software modules executing within one or more suitable processors, as a collection of one or more discrete components or dedicated hardware modules, or any combination thereof. Further, the MIDI processing system can be integrated with existing audio systems of mobile device 100 or other sound generating device.

FIG. 2 is a schematic diagram illustrating instrument priority assignments in accordance with another embodiment of the present invention. As shown in FIG. 2, table 200 illustrates the instruments needed for a particular musical composition. The instrument priority data can be specified within the MIDI data that is to be interpreted by the control logic of a MIDI device. For example, a system exclusive (SYSX) MIDI message can be used to send data such as patch parameters of sample data between MIDI devices. Manufacturers of MIDI equipment can define their own formats for SYSX data and are granted unique identification (ID) numbers by the MIDI Manufacturers' Association (MMA). This manufacturer ID can be included as part of the SYSX message, but since no communication between devices is necessary, the SYSX message for the purposes herein can be used without much difficulty. In this case, the MIDI data requires 9 different instruments to play the composition as intended by the composer or arranger. Each instrument has been assigned a priority ranging from 1–9, where slide guitar is considered the most important instrument to maintain the integrity of the composition and timpani is the least important.

In the example depicted in FIG. 2, the MIDI device has only 8-voice polyphony, or 8 voices available for playing the composition. Accordingly, one instrument must be excluded from the playback. The control logic can select 8 instruments to be used to the play the composition, thereby using all available polyphony of the device. The selected instruments can have the highest priorities, in this case 1–8. Thus, the slide guitar, slap bass, violin, piano, congas, cowbell, shaker, and xylophone are selected and used to play the composition. The timpani is not used. The priority, being assigned by the composer or arranger, indicates which instruments are most important for preserving the integrity of the musical selection. The MIDI device can automatically select the highest priority instruments for playback of the MIDI data in accordance with polyphony constraints of the MIDI device.

FIG. 3 is a schematic diagram illustrating instrument substitutions in accordance with another embodiment of the present invention. For each instrument listed, table 300 specifies a quality rating, a threshold value, and a selected substitution instrument, if applicable. Table 300 is representative of the instruments needed for a given composition as specified by the MIDI data after interpretation and processing by the control logic. That is, table 300 illustrates the case of either a composition requiring only 3 instruments, or a MIDI device having only 3-voice polyphony, having already selected the 3 highest priority instruments for the composition based upon the instrument priority assignments specified in the MIDI data.

Substitute instrument data 305 can list alternative or substitute instruments for one or more or all of the instruments within the MIDI device. Thus, for example, table 310 lists alternative instruments for slide guitar. Table 315 lists alternative instruments or samples for slap bass. Though not shown, additional alternative instrument tables or lists can be included as well. Still, it should be appreciated that lists of alternatives for instruments and thresholds can be specified by the MIDI or music data, or stored in a more persistent manner within the MIDI processing system, for example as system settings. Quality ratings can be stored within the MIDI processing system as system settings as those parameters are device specific.

The control logic can identify instruments needed to play a given composition. Through a comparison of the quality rating of each instrument with the threshold for that instrument, a determination can be made as to whether a replacement instrument should be used. If the quality rating of an instrument is below the threshold, a substitute instrument, if any is specified, can be used in place of the original instrument. The substitute instrument data 305 specifies alternative or substitute instruments. Thus, if an instrument to be used in the composition has a quality rating that is less than the threshold for that instrument, the substitute instrument data 305 can be consulted to determine whether a better sounding instrument alternative exists. This determination is based upon a comparison of the quality rating of the original instrument required by the composition, the threshold, and the quality ratings of the substitute instruments.

Accordingly, in the case illustrated by FIG. 3, since the quality rating of the slide guitar needed to play a composition is less than the threshold set for slide guitar, an alternative instrument can be selected if available. Accordingly, table 310 can be consulted to select a suitable replacement. While any instrument having a quality rating above the threshold specified for the original instrument can be used, in one embodiment, the instrument having the highest quality rating above the threshold can be selected. Thus, the clean guitar is substituted for the slide guitar. Notably, clean guitar has a quality rating that also exceeds the threshold set for the original instrument, slide guitar. No substitutions have been made for slap bass and violin as each of these instruments has a quality rating that exceeds the thresholds set.

Figure 4:
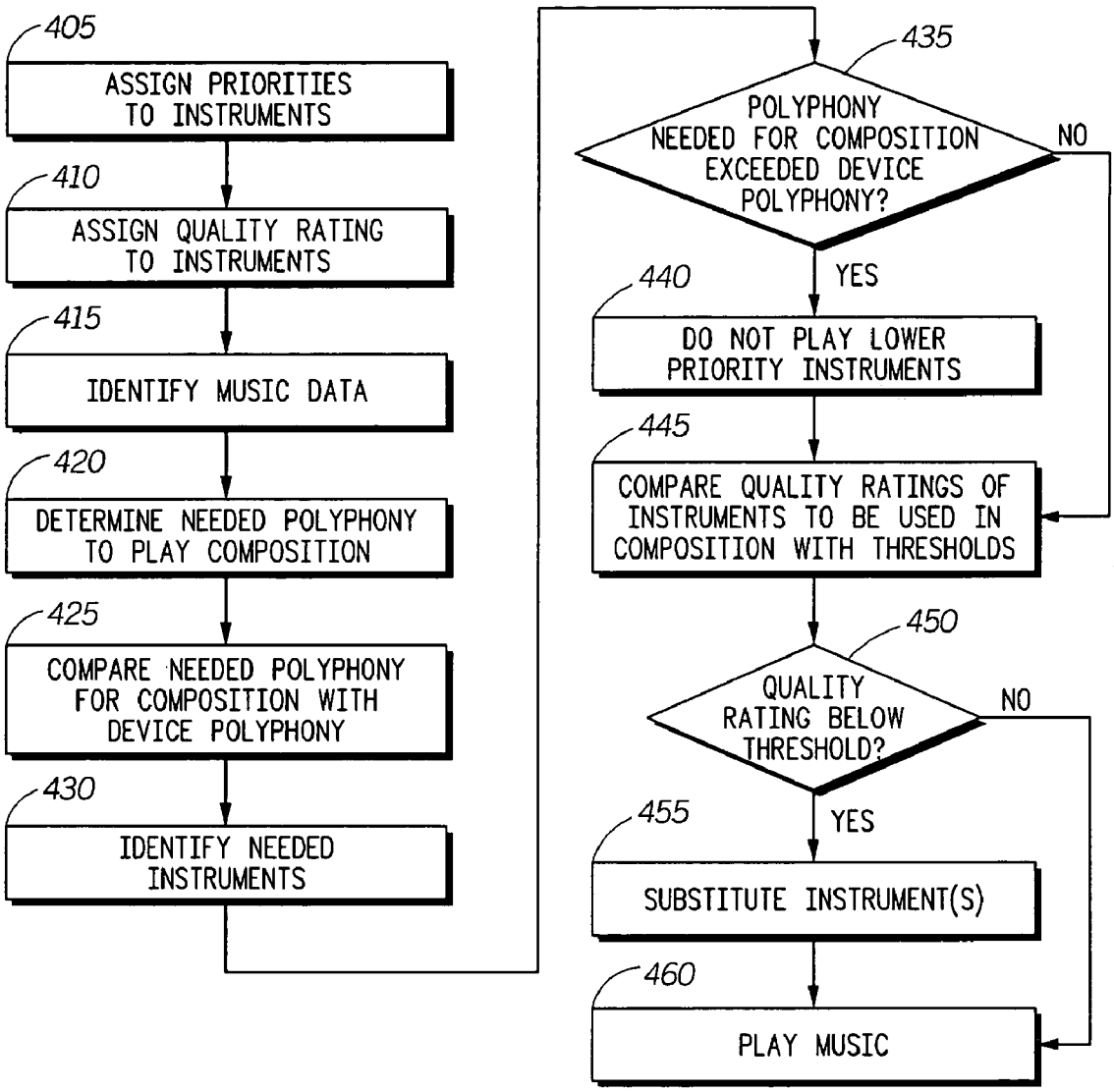
FIG. 4 is a flow chart illustrating a method of processing music data in accordance with yet another embodiment of the present invention.

FIG. 4 is a flow chart illustrating a method 400 of processing music data such as MIDI data in accordance with yet another embodiment of the present invention. The method 400 can begin in step 405 where priorities are assigned to instruments. As noted, the music data itself can specify instrument priorities. This permits the composer to select which instruments are most important in terms of preserving the integrity of the composition when played on MIDI devices of differing polyphony.

In step 410, quality ratings are assigned to the instruments of the MIDI device. The quality ratings can be assigned or programmed when the device is configured, or alternatively, can be adjusted or set by a user according to individual preference. In any case, the quality ratings can be programmed into the MIDI device or mobile device itself.

In step 415, music data, such as a MIDI file, can be identified. The music data can be identified for playback via the MIDI device. The music data can be downloaded from another source or stored within the MIDI device. The music data can specify a particular rendition of a song or composition or any portion thereof. In step 420, the polyphony needed to play the composition specified by the music data can be determined. The polyphony needed to play the composition can be compared with the polyphony of the MIDI device in step 425. In step 430, the instruments needed to play the composition as specified by the music data can be determined.

In step 435, a determination can be made as to whether the polyphony needed to play the composition exceeds that of the MDI device. If not, the method can proceed to step 445. If the polyphony needed to play the composition does exceed that of the MIDI device, the method can continue to step 440. In step 440, the MIDI device can mask instruments and information of the music data that correspond to instruments having a low priority. In general, the MIDI device can use a number of instruments consistent with the polyphony of the MIDI device. For example, if the composition calls for Y instruments, the MIDI device has a polyphony of X, and Y>X, the top X instruments in order of ascending priority from 1 to X can be used to play the composition. The portions of the composition that correspond to instruments having a priority greater than X are masked, or are not played, when the music data is subsequently played.

In step 445, the quality ratings of the instruments to be used in the composition, i.e. the higher priority instruments as determined according the polyphony of the MIDI device, can be compared with the threshold for each instrument. In step 450, a determination can be made as to whether the quality rating of each instrument to be used is below the threshold associated with each instrument. If not, the method can proceed to step 460 to play the composition using the instruments selected according to the polyphony of the MIDI device and the instrument priorities.

If one or more quality ratings of instruments fall below the thresholds, the method can continue to step 455 where alternative instruments are identified for each original instrument specified by the composition having a quality rating that is less than the associated threshold. The alternative instruments can be substituted for the instruments having a quality rating below the associated threshold. The method can proceed to step 460 where the composition is played using the instruments selected according to available polyphony and the instruments selected according to the quality rating.

The method 400, as described herein, has been provided for purposes of illustration only. As such, the examples and illustrations disclosed herein are not intended as a limitation of the present invention. For example, an analysis of instrument quality and instrument substitution can be performed independently of polyphony scaling. Further, polyphony scaling can be performed independently of any analysis with respect to instrument quality and instrument substitution.

The inventive arrangements disclosed herein also can be applied in the case where multiple instantiations or occurrences of a same instrument are used for a composition. In that case, each different instrument part can be assigned a different priority as if the part were to be played by a different instrument. Accordingly, particular parts, despite being played by the same instrument, can be selected and/or masked as discussed herein according to the assigned priorities.

The present invention can be realized in hardware, software, or a combination of hardware and software. Any kind of computer system or other apparatus adapted for carrying out the methods described herein is suited. A typical combination of hardware and software can be a mobile communication device, such as a mobile telephone, with a computer program that, when being loaded and executed, controls the mobile device such that it carries out the methods described herein.

The present invention also can be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention can be embodied in other forms without departing from the spirit or essential attributes thereof. Accordingly, reference should be made to the following claims, rather than to the foregoing specification, as indicating the scope of the invention.

What is claimed is:

1. A method of scaling polyphony comprising:

(a) identifying music data, wherein the music data indicates instruments to be used and each instrument has an assigned priority;

(b) comparing a measure of polyphony needed to play the music data with polyphony of a sound generating device;

(c) if the measure of polyphony exceeds the polyphony of the sound generating device, playing the music data without using one or more instruments indicated by the music data according to the assigned priorities;

(d) for at least one instrument indicated by the music data, comparing a quality rating of the instrument on the sound generating device with a threshold corresponding to the instrument, wherein the sound generating device specifies quality ratings for the instruments; and (e) if the quality rating of the instrument is less than the threshold, selecting a substitute instrument having a quality rating that exceeds the threshold, wherein a substitution of a higher quality instrument is merited based upon a sound quality of N alternative instruments available to the sound generating device, and using the substitute instrument in place of the at least one instrument of said step (d) during said step (c).

2. The method of claim 1, wherein the device is a mobile communication device.

3. The method of claim 1, said step (c) further comprising identifying the one or more instruments of the sound generating device as having a low sound quality priority.

4. The method of claim 3, wherein one of the identified one or more instruments has a lowest priority.

5. The method of claim 1, said step of playing the music data comprising using instruments having a sound quality priority of 1 to N, where the polyphony of the sound generating device is equivalent to N.

6. The method of claim 1, wherein the steps of identifying music data and comparing the measure of polyphony comprises synthesizing music data.

7. The method of claim 1, wherein the step of comparing the quality rating of the instrument on the sound generation device is done on a composition by composition basis.

8. A method of selecting instruments comprising:

identifying music data;

for at least one instrument indicated by the music data, comparing a quality rating of the instrument on a sound generating device with a threshold corresponding to the instrument, wherein the sound generating device specifies quality ratings for the instruments;

if the quality rating of the instrument is less than the threshold, substituting a replacement instrument for the instrument, wherein a replacement of a higher quality instrument is merited based upon a sound quality of N alternative instruments available to the sound generating device, and wherein the replacement instrument has a quality rating that is higher than the threshold; and playing the music data using the replacement instrument.

9. The method of claim 8, wherein the sound generating device is a mobile communication device.

10. A machine readable storage, having stored thereon a computer program having a plurality of code sections executable by a machine for causing the machine to perform the steps of:

(a) identifying music data, wherein the music data indicates instruments to be used and each instrument has an assigned priority;

(b) comparing a measure of polyphony needed to play the music data with polyphony of a sound generating device; and (c) if the measure of polyphony exceeds the polyphony of the sound generating device, playing the music data without using one or more instruments indicated by the music data according to the assigned priorities;

(d) for at least one instrument indicated by the music data, comparing a quality rating of the instrument on the sound generating device with a threshold corresponding to the instrument, wherein the sound generating device specifies quality ratings for the instruments; and (e) if the quality rating of the instrument is less than the threshold, selecting a substitute instrument having a quality rating that exceeds the threshold, wherein a substitution of a higher quality instrument is merited based upon a sound quality of N alternative instruments available to the sound generating device, and using the substitute instrument in place of the at least one instrument of said step (d) during said step (c).

11. The machine readable storage of claim 10, wherein the device is a mobile communication device.

12. The machine readable storage of claim 10, said step (c) further comprising identifying the one or more instruments of the sound generating device as having a low sound quality priority.

13. The machine readable storage of claim 12, wherein one of the identified one or more instruments has a lowest priority.

14. The machine readable storage of claim 10, said step of playing the music data comprising using instruments having a sound quality priority of 1 to N, where the polyphony of the sound generating device is equivalent to N.

15. A machine readable storage, having stored thereon a computer program having a plurality of code sections executable by a machine for causing the machine to perform the steps of:

identifying music data;

for at least one instrument indicated by the music data, comparing a quality rating of the instrument on a sound generating device with a threshold corresponding to the instrument, wherein the sound generating device specifies quality ratings for the instruments;

if the quality rating of the instrument is less than the threshold, substituting a replacement instrument for the instrument, wherein a replacement of a higher quality instrument is merited based upon a sound quality of N alternative instruments available to the sound generating device, and wherein the replacement instrument has a quality rating that is higher than the threshold; and playing the music data using the replacement instrument.

16. The machine readable storage of claim 15, wherein the sound generating device is a mobile communication device.

* * * * *